US010985460B2

(12) United States Patent
Chang et al.

(10) Patent No.: US 10,985,460 B2
(45) Date of Patent: Apr. 20, 2021

(54) ANTENNA STRUCTURE

(71) Applicant: Chiun Mai Communication Systems, Inc., New Taipei (TW)

(72) Inventors: Yun-Jian Chang, New Taipei (TW); Geng-Hong Liou, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 0 days.

(21) Appl. No.: 16/535,215

(22) Filed: Aug. 8, 2019

(65) Prior Publication Data

US 2020/0052401 A1 Feb. 13, 2020

(30) Foreign Application Priority Data

Aug. 9, 2018 (CN) ..... 201810903857.2

(51) Int. Cl.

| | |
|---|---|
| ***H01Q 5/371*** | (2015.01) |
| ***H01Q 5/335*** | (2015.01) |
| ***H01Q 5/328*** | (2015.01) |
| ***H01Q 21/00*** | (2006.01) |
| ***H01Q 9/04*** | (2006.01) |
| ***H01Q 9/14*** | (2006.01) |
| ***H01Q 13/10*** | (2006.01) |
| ***H01Q 1/24*** | (2006.01) |

(52) U.S. Cl.

CPC ..... *H01Q 5/371* (2015.01); *H01Q 1/243* (2013.01); *H01Q 5/328* (2015.01); *H01Q 5/335* (2015.01); *H01Q 9/0407* (2013.01); *H01Q 9/14* (2013.01); *H01Q 13/10* (2013.01); *H01Q 21/0006* (2013.01)

(58) Field of Classification Search

CPC ..... H01Q 1/243; H01Q 1/125; H01Q 1/185
See application file for complete search history.

(56) References Cited

U.S. PATENT DOCUMENTS

| | | | | |
|---|---|---|---|---|
| 9,236,659 | B2 * | 1/2016 | Vazquez | H01Q 9/145 |
| 9,331,397 | B2 * | 5/2016 | Jin | H01Q 9/06 |
| 9,634,709 | B2 * | 4/2017 | Hu | H04B 1/3888 |
| 10,224,606 | B2 * | 3/2019 | Kim | H01Q 5/335 |
| 10,665,926 | B2 * | 5/2020 | Kim | H04M 1/0266 |
| 2015/0084817 | A1 | 3/2015 | Yong | |
| 2018/0090847 | A1 * | 3/2018 | Romano | H01Q 9/285 |

FOREIGN PATENT DOCUMENTS

| | | |
|---|---|---|
| CN | 107039766 | 8/2017 |
| TW | 201804661 | 2/2018 |

* cited by examiner

*Primary Examiner* — Daniel D Chang
(74) *Attorney, Agent, or Firm* — ScienBiziP, P.C.

(57) ABSTRACT

An antenna structure includes a border frame, a first feed portion, a second feed portion, and two ground portions. The border frame includes a first gap and a second gap passing through the border frame, thereby defining a first radiating portion and a second radiating portion. The first feed portion is electrically coupled to the first radiating portion to supply an electric current to the first radiating portion. The second feed portion is electrically coupled to the second radiating portion to supply an electric current to the second radiating portion. The two ground portions are disposed between the first feed portion and the second feed portion and separated from each other. The two ground portions are electrically coupled to the first radiating portion or the second radiating portion.

12 Claims, 14 Drawing Sheets

ANTENNA STRUCTURE

FIELD

The subject matter herein generally relates to antenna structures, and more particularly to an antenna structure of a wireless communication device.

BACKGROUND

Electronic devices such as mobile phones and personal digital assistants may implement full-screen designs. However, how to not compress a clearance area of an antenna of the electronic device having a full-screen design is an important issue when designing an antenna.

BRIEF DESCRIPTION OF THE DRAWINGS

Implementations of the present disclosure will now be described, by way of embodiments only, with reference to the attached FIG.s.

DETAILED DESCRIPTION

Figure 1:
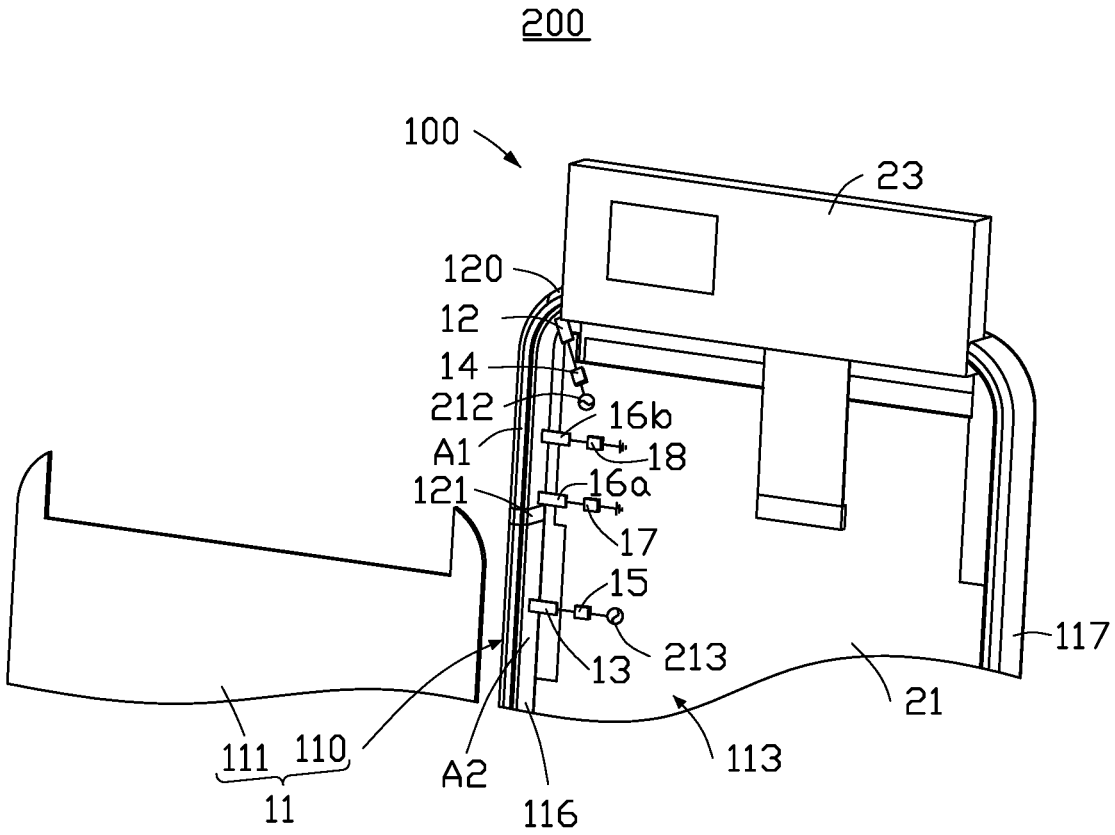
FIG. 1 is a partially exploded perspective view of an antenna structure applied in a wireless communication device according to a first embodiment.

It will be appreciated that for simplicity and clarity of illustration, where appropriate, reference numerals have been repeated among the different FIG.s to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as coupled, whether directly or indirectly through intervening components, and is not necessarily limited to physical connections. The connection can be such that the objects are permanently coupled or releasably coupled. The term "substantially" is defined to be essentially conforming to the particular dimension, shape, or other word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series and the like.

Figure 2:
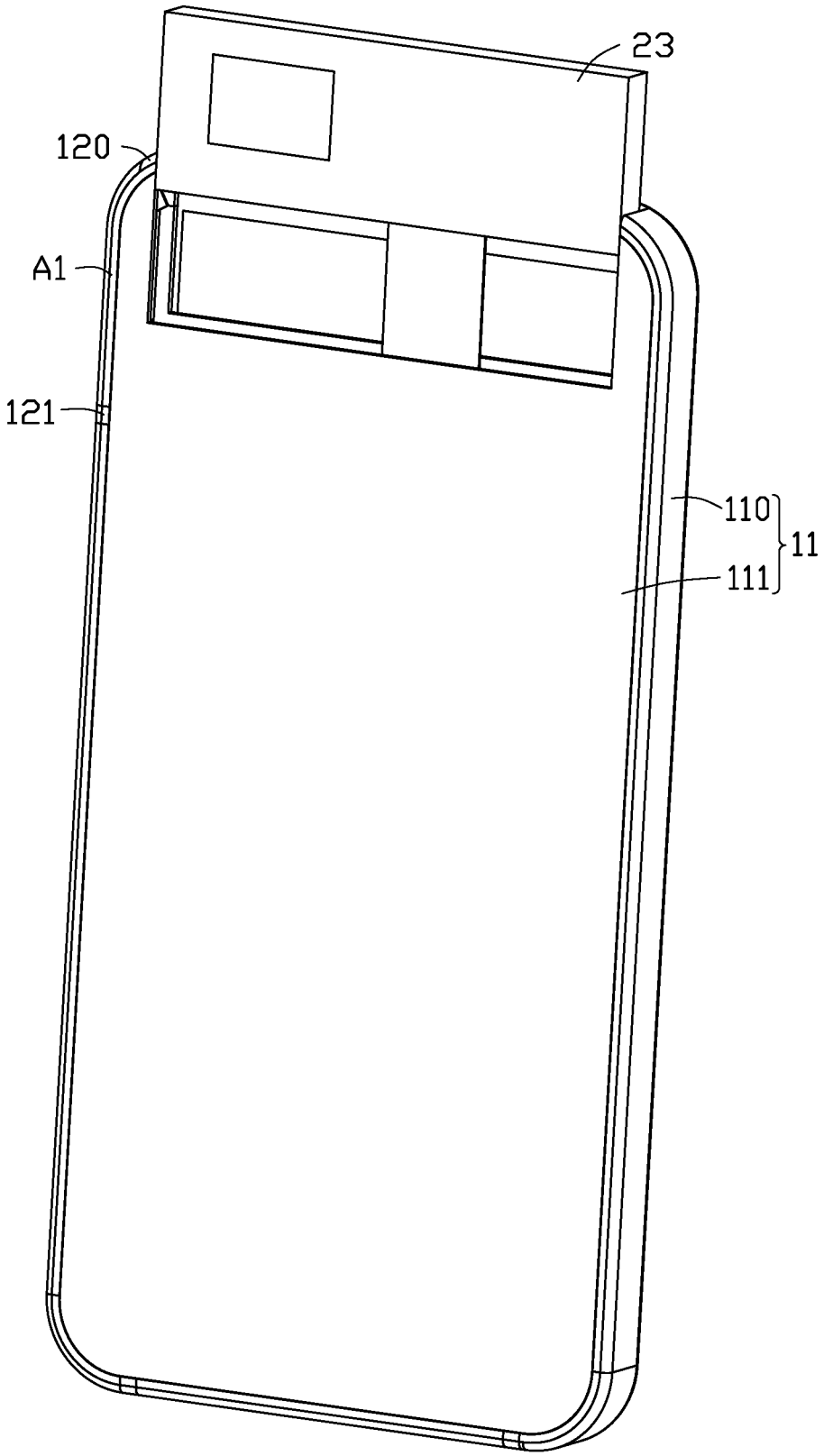
FIG. 2 is a schematic view showing a back side of the wireless communication device in FIG. 1.
Figure 3:
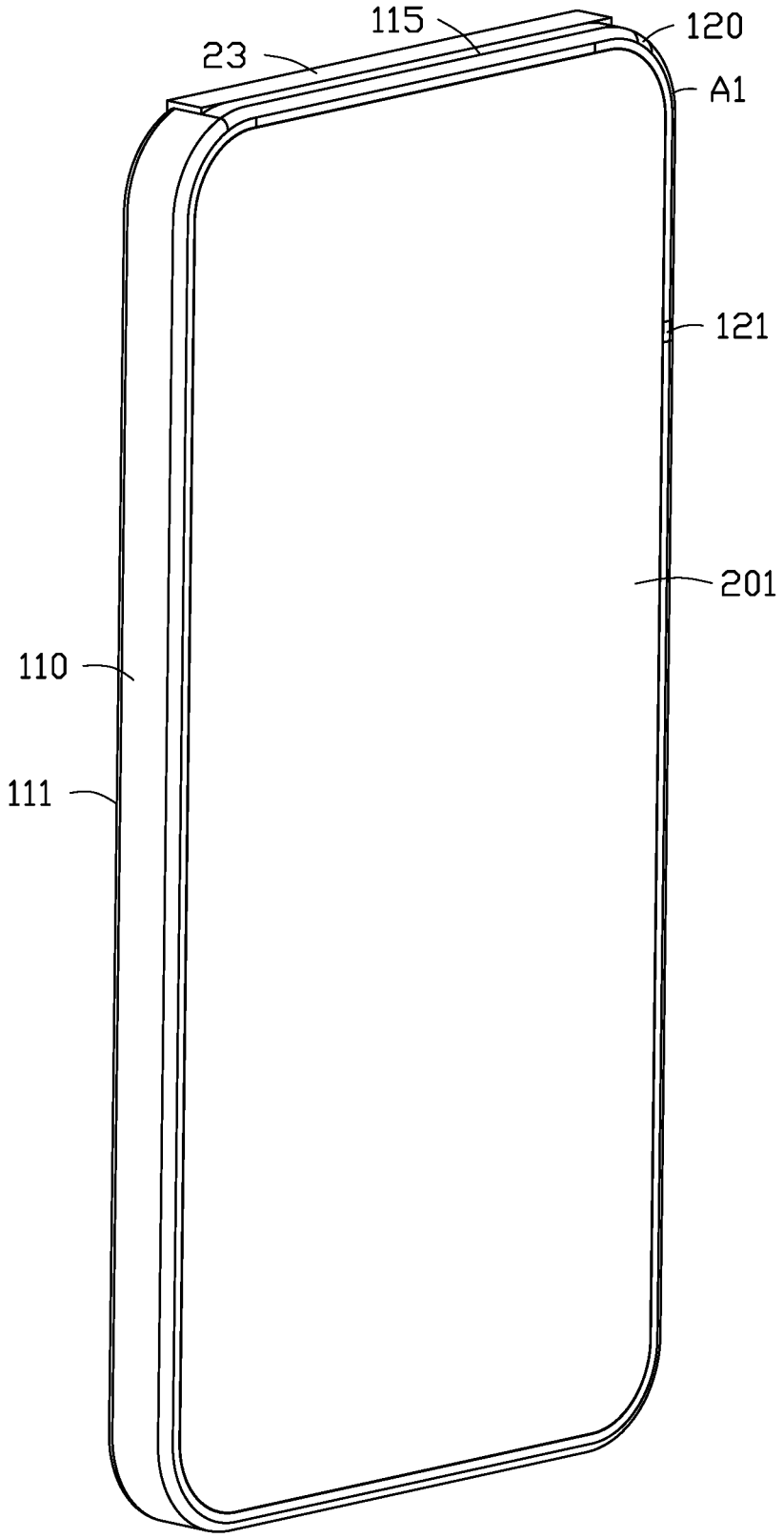
FIG. 3 is a front elevational view of the wireless communication device of FIG. 1.

Referring to FIGS. 1-3, a first embodiment of an antenna structure 100 applicable in a wireless communication device 200 is shown. The wireless communication device 200 may be a mobile phone, a personal digital assistant, or any other electronic device for transmitting and receiving wireless signals.

The antenna structure 100 includes at least a housing 11, a first feed portion 12, a second feed portion 13, and at least two ground portions.

The housing 11 can be an outer casing of the wireless communication device 200. The housing 11 includes at least a border frame 110 and a backplane 111. The border frame 110 has a substantially annular structure and is made of metal. One side of the border frame 110 defines an opening (not shown) for receiving a display unit 201 of the wireless communication device 200 (shown in FIG. 3). The display unit 201 includes a complete unnotched display plane. The display plane is exposed from the opening.

The backplane 111 is made of metal. The backplane 111 is arranged on a periphery of the border frame 110 and is substantially parallel to the display plane of the display unit 201. In one embodiment, the backplane 111 is integrally formed with the border frame 110 and the backplane 111 and the border frame 110 cooperatively define an accommodating space 113. The accommodating space 113 receives an electronic component or a circuit module, such as a substrate and a processing unit, of the wireless communication device 200.

The border frame 110 includes at least an end portion 115 (shown in FIG. 3), a first side portion 116, and a second side portion 117. In one embodiment, the end portion 115 may be a top end of the wireless communication device 200. The first side portion 116 is arranged opposite to the second side portion 117, and the first side portion 116 and the second side portion 117 facing each other are respectively coupled to two ends of the end portion 115 substantially perpendicularly. The end portion 115, the first side portion 116, and the second side portion 117 are both coupled to the backplane 111 and the display unit 201. In one embodiment, lengths of the first side portion 116 and the second side portion 117 are both greater than a length of the end portion 115.

The border frame 110 includes a first gap 120 and a second gap 121. The first gap 120 is located where the first side portion 116 is adjacent to the end portion 115. The second gap 121 is spaced from the first gap 120. In one embodiment, the second gap 121 is located on the first side portion 116 and is located on a side of the first gap 120 away from the end portion 115.

In one embodiment, the first gap 120 and the second gap 121 both pass through the border frame 110, thereby defining a first radiating portion A1 and a second radiating portion A2. A portion of the border frame 110 between the first gap 120 and the second gap 121 is defined as the first radiating portion A1. A portion of the first side portion 116 on a side of the second gap 121 away from the first gap 120 is defined as the second radiating portion A2. Thus, the first side portion 116 forms the second radiating portion A2.

In one embodiment, the first radiating portion A1 and the second radiating portion A2 are spaced apart and located on one side of the end portion 115, such as located on the first side portion 116. In other embodiments, the first gap 120 may also be formed in the end portion 115, such that the first radiating portion A1 is disposed in the end portion 115 and the first side portion 116. Thus, the first radiating portion A1 and the second radiating portion A2 are partially or entirely disposed in a same side of the border frame 110, such as the first side portion 116.

In one embodiment, the first gap 120 and the second gap 121 are filled with an insulating material, such as plastic, rubber, glass, wood, or ceramic.

In one embodiment, a size of the wireless communication device 200 is approximately 70 mm*140 mm*8 mm. The wireless communication device 200 further includes a substrate 21 and an electronic component 23. The substrate 21 is a printed circuit board (PCB), which can be made of a dielectric material such as epoxy glass fiber (FR4). The substrate 21 is received in the accommodating space 113. At least one end of the substrate 21 is spaced from the border frame 110 to form a corresponding clearance area 211 therebetween.

In one embodiment, the electronic component 23 is an optical module. The electronic component 23 is arranged on the substrate 21 and is electrically coupled to the substrate 21. In one embodiment, the optical module may include one or more of a camera module, an auxiliary display screen, and a light sensor (an ambient light sensor, a proximity sensor, or the like). In other embodiments, the electronic component 23 can be an acoustic module. The acoustic module may include one or more of a horn, a microphone, and a vibration motor.

In one embodiment, the wireless communication device 200 can further include a sliding structure (not shown). The sliding structure is coupled to the electronic component 23 for controlling the electronic component 23 to slide relative to the border frame 110. When the electronic component 23 is slid to a first position, the electronic component 23 is located within the border frame 110, and the electronic component 23 is in a closed state. When the electronic component 23 slides to a second position, the electronic component 23 slides out of the border frame 110 from one side of the border frame 110, such as the end portion 115, and the electronic component 23 is in an open state. In one embodiment, the first radiating portion A1 and the second radiating portion A2 are both arranged on the same side of the electronic component 23. Thus, the electronic component 23 can be effectively prevented from interfering with radiation of the first radiating portion A1 and the second radiating portion A2.

Figure 4:
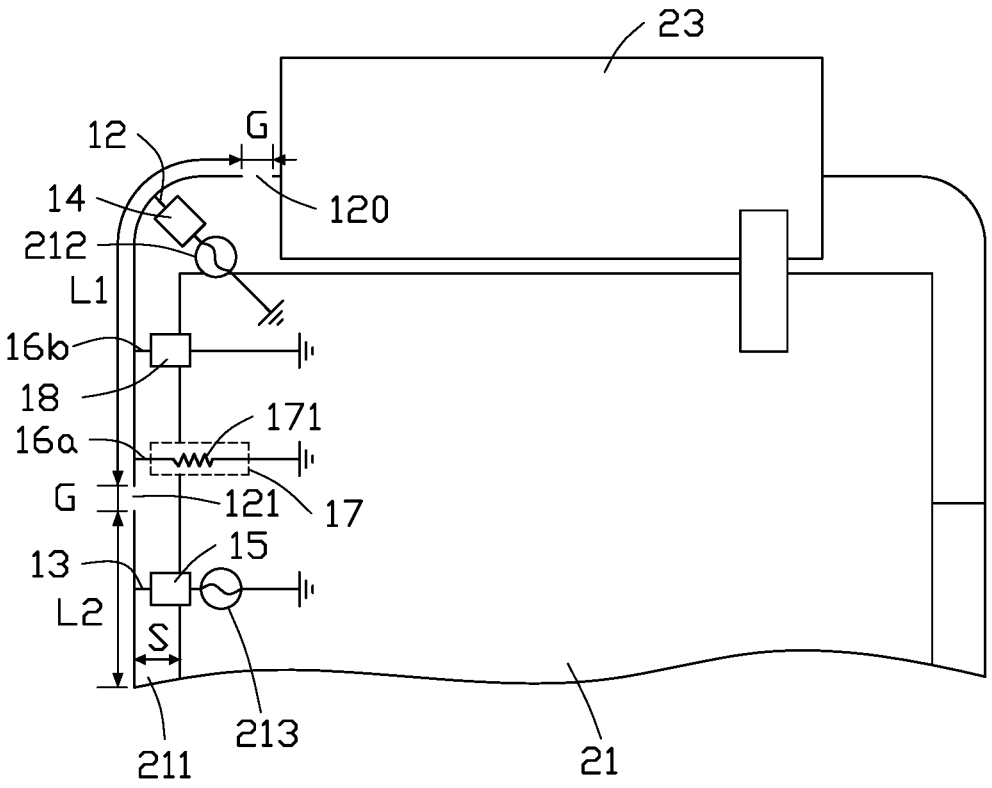
FIG. 4 is a circuit diagram of the antenna structure in the wireless communication device shown in FIG. 1.

Referring to FIG. 4, in one embodiment, widths of the first gap 120 and the second gap 121 are both G. A length of the first radiating portion A1 is L1. A length of the second radiating portion A2 is L2. A width of the clearance area 211 is S. In one embodiment, G is 2 mm, L1 is 28.5 mm, L2 is 19 mm, and S is 2.5 mm.

In one embodiment, the first feed portion 12 is located in the accommodating space 113. The first feed portion 12 may be a metal dome, a screw, a feeder, a probe, or the like. One end of the first feed portion 12 is electrically coupled to one side of the first radiating portion A1 adjacent to the first gap 120, and a second end is electrically coupled to a first feed source 212 of the substrate 21 through a first matching circuit 14. The first feed source 212 supplies an electric current to the first radiating portion A1. The first feed source 212 is grounded.

The second feed portion 13 is located in the accommodating space 113. The second feed portion 13 may be a metal dome, a screw, a feeder, a probe, or the like. One end of the second feed portion 13 is electrically coupled to the second radiating portion A2, and a second end is electrically coupled to a second feed source 213 of the substrate 21 through a second matching circuit 15. The second feed source 213 supplies an electric current to the second radiating portion A2. The second feed source 213 is grounded.

In one embodiment, the antenna structure 100 includes two ground portions, such as a first ground portion **16*a* and a second ground portion 16*b*. The two ground portions are located in the accommodating space 113 between the first feed portion 12 and the second feed portion 13. In one embodiment, the two ground portions may be metal spring pieces, screws, feeders, probes, or the like. One end of the first ground portion 16*a* is electrically coupled to a side of the first radiating portion A1 adjacent to the second gap 121, and a second end of the first ground portion 16*a* is grounded through a first load circuit 17. One end of the second ground portion 16*b* is electrically coupled to the first radiating portion A1, and a second end of the second ground portion 16*b* is grounded through a second load circuit 18. Both of the ground portions provide grounding for the first radiating portion A1 and improve isolation between the first radiating portion A1 and the second radiating portion A2**.

Figure 5:
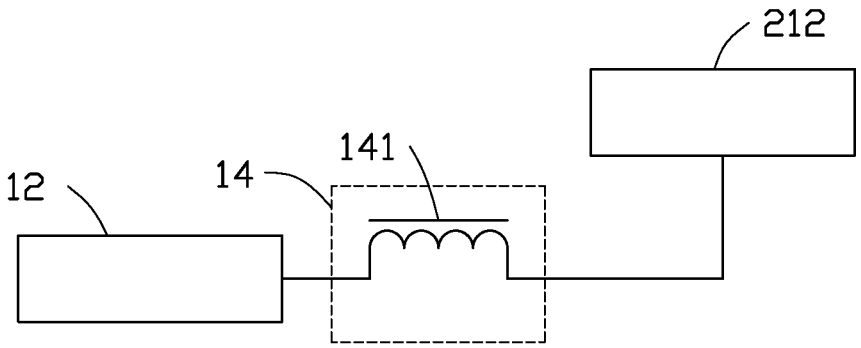
FIG. 5 is a circuit diagram of a first matching circuit in the antenna structure shown in FIG. 4.

Referring to FIG. 5, in one embodiment, the first matching circuit 14 optimizes impedance matching between the first feed source 212 and the first radiating portion A1. The first matching circuit 14 includes a matching unit 141. One end of the matching unit 141 is electrically coupled to the first feed portion 12 to be electrically coupled to the first radiating portion A1 through the first feed portion 12. A second end of the matching unit 141 is electrically coupled to the first feed source 212.

In one embodiment, the matching unit 141 is an inductor. An inductance value of the matching unit 141 is 15 nH. In other embodiments, the matching unit 141 is not limited to the inductor described above, and may be other inductors, capacitors, or a combination thereof.

Figure 6:
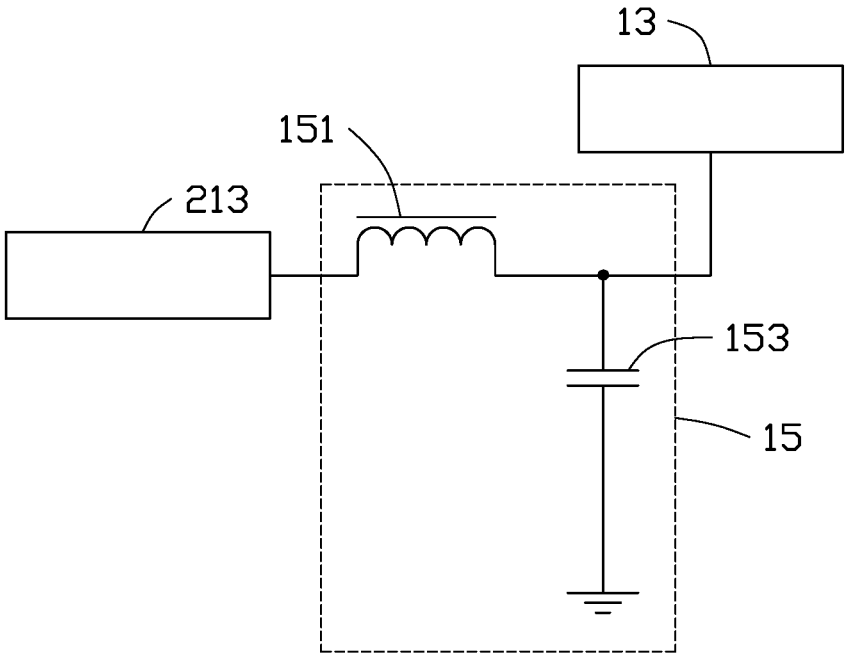
FIG. 6 is a circuit diagram of a second matching circuit in the antenna structure shown in FIG. 4.

Referring to FIG. 6, in one embodiment, the second matching circuit 15 optimizes impedance matching between the second feed source 213 and the second radiating portion A2. The second matching circuit 15 includes a first matching component 151 and a second matching component 153. One end of the first matching component 151 is electrically coupled to the second feed portion 13 to be electrically coupled to the second radiating portion A2 through the second feed portion 13. A second end of the first matching component 151 is electrically coupled to the second feed source 213. One end of the second matching component 153 is electrically coupled between the first matching component 151 and the second feed portion 13, and a second end is grounded.

In one embodiment, the first matching component 151 is an inductor, and the second matching component 153 is a capacitor. An inductance value of the first matching component 151 is 1 nH. A capacitance value of the second matching component 153 is 0.5 pF. In other embodiments, the first matching component 151 and the second matching component 153 are not limited to the capacitors and inductors described above, and may be other inductors, capacitors, or a combination thereof.

In one embodiment, the first load circuit 17 includes a load component 171. One end of the load component 171 is electrically coupled to a corresponding ground portion, such as the first ground portion 16*a*, and a second end is grounded. The load component 171 is a 0 ohm resistor. In other embodiments, the load component 171 is not limited to the 0 ohm resistor described above, and may be other load components, such as resistors, inductors, capacitors, or a combination thereof, or a switch with resistors, inductors, capacitors, or a combination thereof.

In one embodiment, a circuit structure and working principle of the second load circuit 18 are the same as those of the first load circuit 17, and so details are not described herein again.

After an electric current is supplied from the first feed source 212, the electric current is directly supplied to the first radiating portion A1 through the first matching circuit 14 and the first feed portion 12, and then flows to the second gap 121. Thus, the first radiating portion A1 forms a first antenna for exciting a first resonance mode to generate a radiation signal in a first frequency band. Simultaneously, when the electric current is supplied from the second feed source 213, the electric current is directly supplied to the second radiating portion A2 through the second matching circuit 15 and the second feed portion 13. Thus, the second radiating portion A2 forms a second antenna for exciting a second resonance mode to generate a radiation signal in a second frequency band.

In one embodiment, the first antenna is a Global Positioning System (GPS) antenna, and the second antenna is a WIFI antenna. The first resonance mode is a GPS mode, and the second resonance mode is a WIFI mode.

Figure 7:
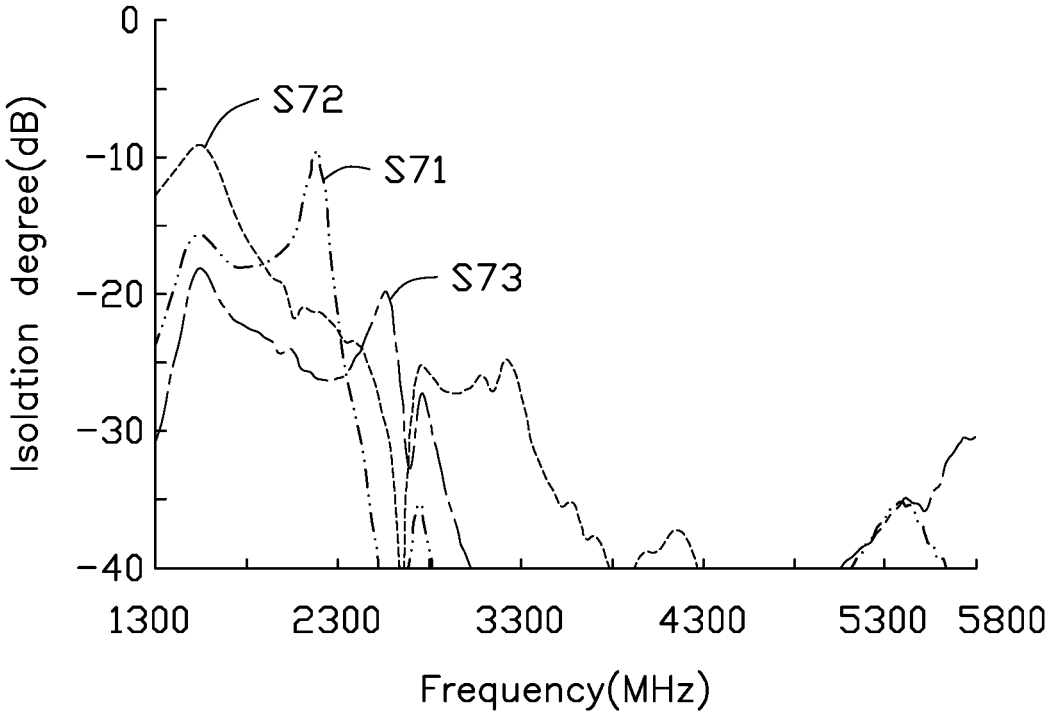
FIG. 7 is a graph showing an isolation degree of the antenna structure when an electronic component of FIG. 4 is in a closed state.

FIG. 7 is a graph of isolation degree of the antenna structure 100 when the electronic component 23 is in the closed state. A plotline S71 is an isolation degree between the first radiating portion A1 and the second radiating portion A2 when the antenna structure 100 only includes the first ground portion 16*a* and not the second ground portion 16*b* and the electronic component 23 is in the closed state. A plotline S72 is an isolation degree between the first radiating portion A1 and the second radiating portion A2 when the antenna structure 100 only includes the second ground portion 16*b* and not the first ground portion 16*a* and the electronic component 23 is in the closed state. A plotline S73 is an isolation degree between the first radiating portion A1 and the second radiating portion A2 when the antenna structure 100 includes both the first ground portion 16*a* and the second ground portion 16*b* and the electronic component 23 is in the closed state.

Figure 8:
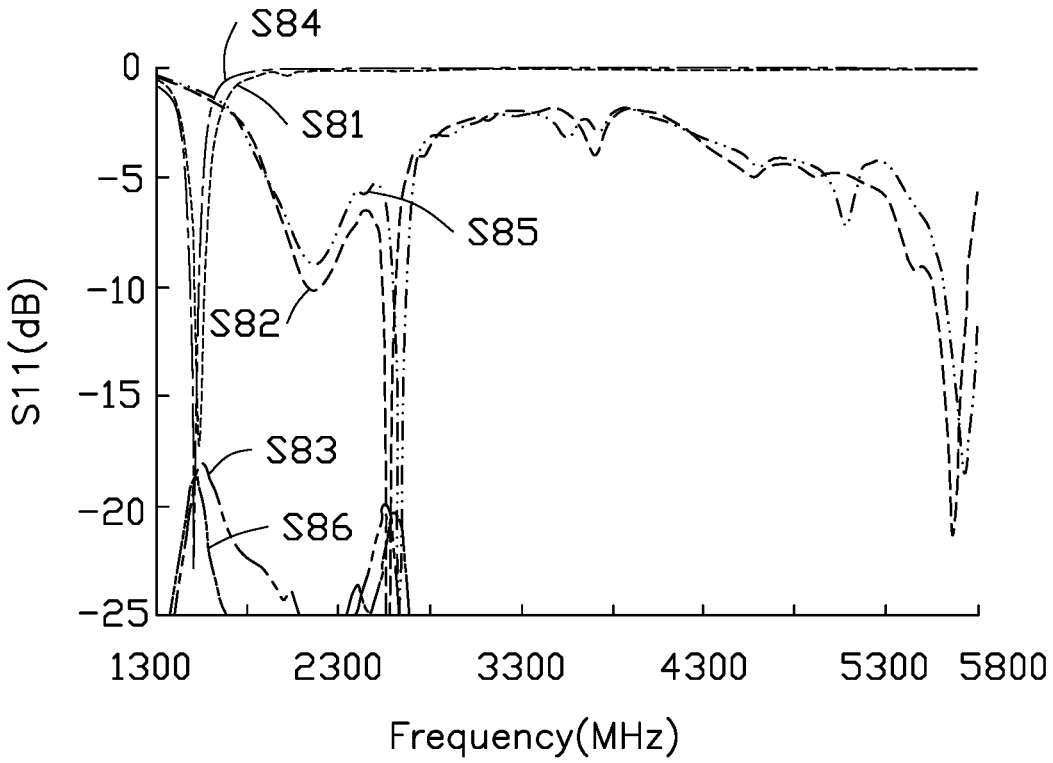
FIG. 8 is a graph of scattering parameters (S11 values) of the antenna structure of FIG. 1.

FIG. 8 is a graph of scattering parameters (S11 values) of the antenna structure 100. A plotline S81 is the S11 values of the first radiating portion A1 when the electronic component 23 is in the off state. A plotline S82 is the S11 values of the second radiating portion A2 when the electronic component 23 is in the closed state. A plotline S83 is an isolation degree between the first radiating portion A1 and the second radiating portion A2 when the electronic component 23 is in the closed state. A plotline S84 is the S11 values of the first radiating portion A1 when the electronic component 23 is in the open state. A plotline S85 is the S11 values of the second radiating portion A2 when the electronic component 23 is in the open state. A plotline S86 is an isolation degree between the first radiating portion A1 and the second radiating portion A2 when the electronic component 23 is in the open state.

Figure 9:
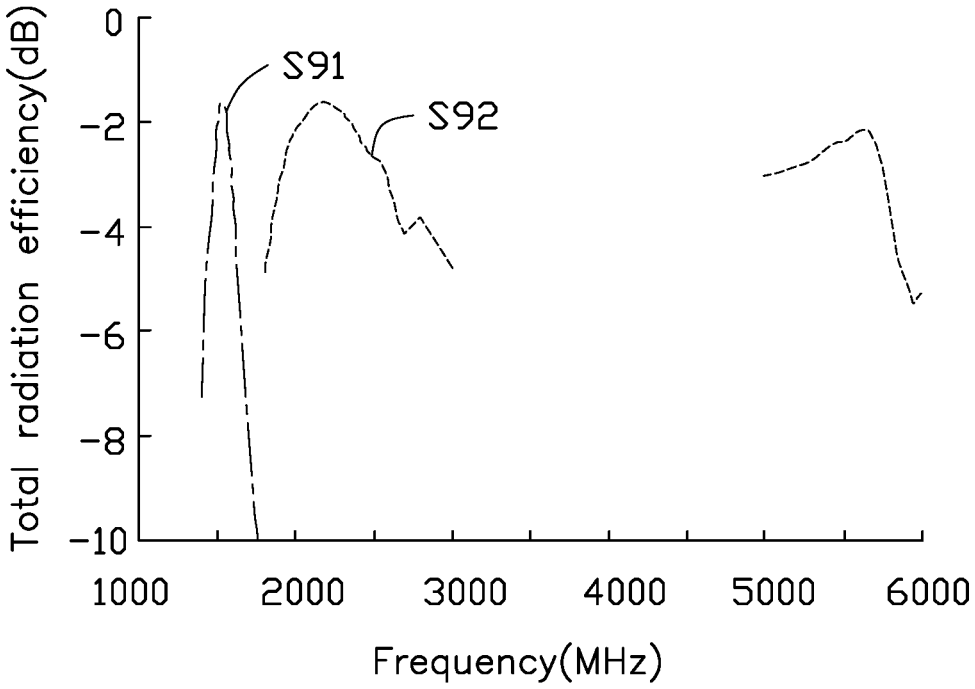
FIG. 9 is a graph of total radiation efficiency of the antenna structure when the electronic component of FIG. 4 is in a closed state.

FIG. 9 is a graph of total radiation efficiency of the antenna structure 100 when the electronic component 23 is in the closed state. A plotline S91 is the total radiation efficiency of the first radiating portion A1 when the electronic component 23 is in the closed state. A plotline S92 is the total radiation efficiency of the second radiating portion A2 when the electronic component 23 is in the closed state.

Figure 10:
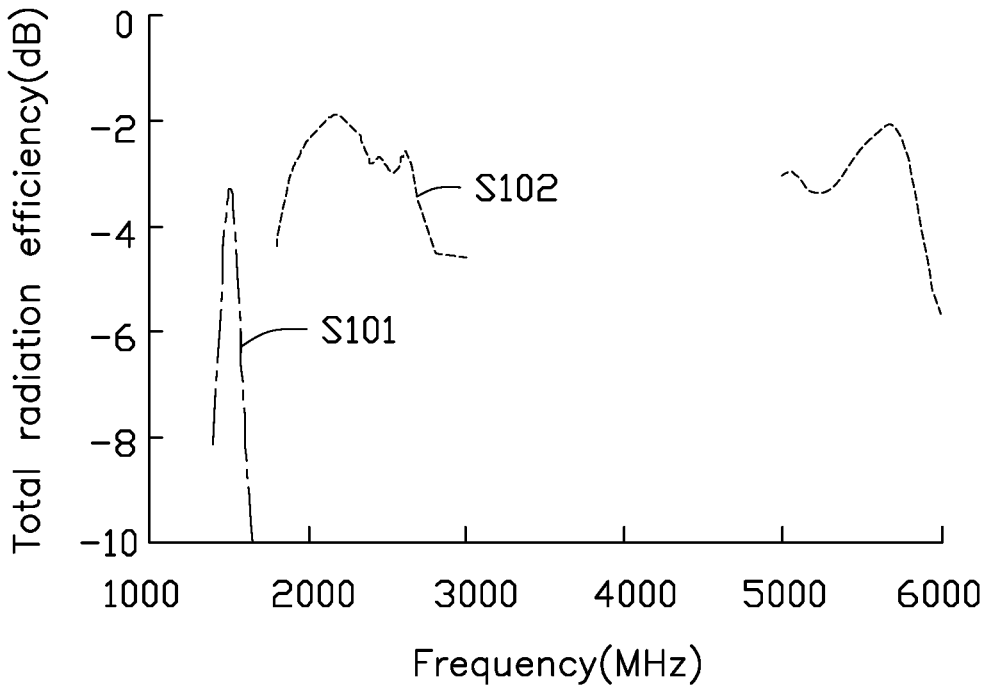
FIG. 10 is a graph of total radiation efficiency of the antenna structure when the electronic component of FIG. 4 is in an open state.

FIG. 10 is a graph of total radiation efficiency of the antenna structure 100 when the electronic component 23 is in the open state. A plotline S101 is the total radiation efficiency of the first radiating portion A1 when the electronic component 23 is in the open state. A plotline S102 is the total radiation efficiency of the second radiating portion A2 when the electronic component 23 is in the open state.

As shown in FIGS. 7-10, when the electronic component 23 is in the open state or the closed state, the first antenna (the first radiating portion A1) and the second antenna (the second radiating portion A2) both have a wide bandwidth and a good isolation degree therebetween. The isolation degree is less than −15 dB. Moreover, when the electronic component 23 is in the open state or the closed state, the total radiation efficiency of the first antenna (the first radiating portion A1) and the total radiation efficiency of the second antenna (the second radiating portion A2) both are greater than −4 dB, thereby meeting antenna design requirements.

Figure 11:
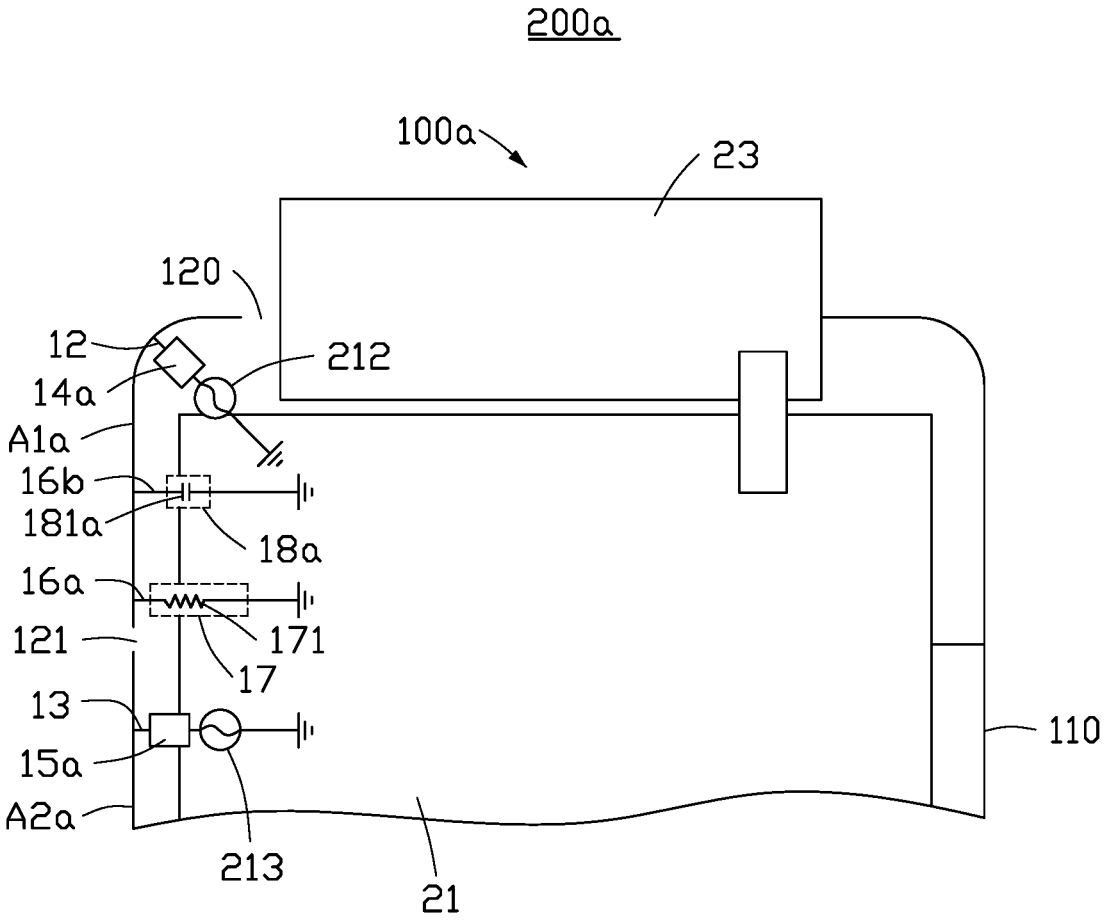
FIG. 11 is a schematic diagram of an antenna structure applied in a wireless communication device according to a second embodiment.

FIG. 11 shows an antenna structure 100*a* according to a second embodiment applicable in a wireless communication device 200*a* such as a mobile phone or a personal digital assistant for transmitting and receiving wireless signals.

The wireless communication device 200*a* includes an electronic component 23. The antenna structure 100*a* includes a border frame 110, a first feed portion 12, a second feed portion 13, a first matching circuit 14*a*, a second matching circuit 15*a*, a first ground portion 16*a*, a second ground portion 16*b*, a first load circuit 17, and a second load circuit 18*a*. The border frame 110 includes a first gap 120 and a second gap 121. The first gap 120 and the second gap 121 pass through the border frame 110 to cooperatively define a first radiating portion A1*a* and a second radiating portion A2*a*.

A difference between the antenna structure 100*a* and the antenna structure 100 is that circuit structures of the first matching circuit 14*a*, the second matching circuit 15*a*, and the second load circuit 18*a* are different from circuit structures of the first matching circuit 14, the second matching circuit 15, and the second load circuit 18.

Figure 12:
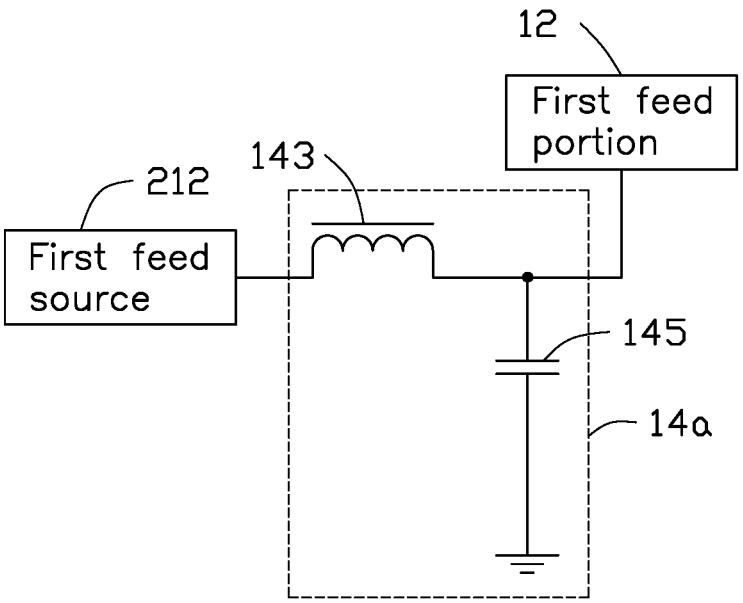
FIG. 12 is a circuit diagram of a first matching circuit in the antenna structure shown in FIG. 11.

Referring to FIG. 12, in one embodiment, the first matching circuit 14*a* includes a first matching unit 143 and a second matching unit 145. One end of the first matching unit 143 is electrically coupled to the first feed portion 12, and is further electrically coupled to the first radiating portion A1*a* through the first feed portion 12. A second end of the first matching unit 143 is electrically coupled to the first feed source 212. One end of the second matching unit 145 is electrically coupled between the first matching unit 143 and the first feed portion 12, and a second end is grounded.

In one embodiment, the first matching unit 143 is an inductor, and the second matching unit 145 is a capacitor. An inductance value of the first matching unit 143 is 12 nH. A capacitance value of the second matching unit 145 is 0.5 pF. In other embodiments, the first matching unit 143 and the second matching unit 145 are not limited to the capacitors and inductors described above, and may be other inductors, capacitors, or a combination thereof.

Figure 13:
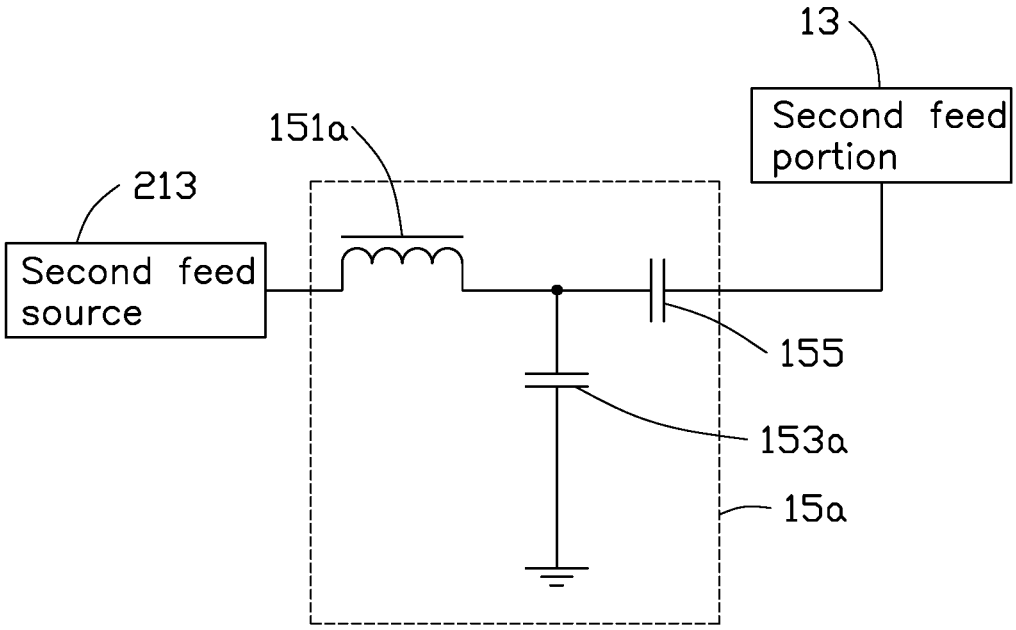
FIG. 13 is a circuit diagram of a second matching circuit in the antenna structure shown in FIG. 11.

Referring to FIG. 13, in one embodiment, the second matching circuit 15*a* includes a first matching component 151*a*, a second matching component 153*a*, and a third matching component 155. One end of the first matching component 151*a* is electrically coupled to the second feed portion 13 through the third matching component 155 coupled in series, and is further electrically coupled to the second radiating portion A2*a* through the second feed portion 13. A second end of the first matching component 151*a* is electrically coupled to the second feed source 213. One end of the second matching component 153*a* is electrically coupled between the first matching component 151*a* and the third matching component 155, and a second end is grounded.

In one embodiment, the first matching component 151*a* is an inductor, and the second matching component 153*a* and the third matching component 155 are both capacitors. An inductance value of the first matching component 151*a* is 2.1 nH. Capacitance values of the second matching component 153*a* and the third matching component 155 are 0.3 pF and 2.1 pF, respectively. In other embodiments, the first matching component 151*a*, the second matching component 153*a*, and the third matching component 155 are not limited to the capacitors and inductors described above, and may be other inductors, capacitors, or a combination thereof.

Referring again to FIG. 11, in one embodiment, the load component 181*a* in the second load circuit 18*a* is a capacitor instead of a 0 ohm resistor. The load component 181*a* has a capacitance value of 15 pF. One end of the load component 181*a* is electrically coupled to the second ground portion 16*b*, and a second end is grounded.

In other embodiments, the load component 181*a* can be a resistor, an inductor, a capacitor, or a combination thereof, or a switch with a resistor, an inductor, a capacitor, or a combination thereof.

By changing a circuit structure of the first matching circuit 14/14*a*, the second matching circuit 15/15*a*, the first load circuit 17 and/or the second load circuit 18/18*a*, operating frequencies of the first radiating portion A1/A1*a* and the second radiating portion A2/A2*a* can be changed or adjusted according to requirements. In one embodiment, the first radiating portion A1*a* and the second radiating portion A2*a* are both diversity antennas. The first radiating portion A1*a* can operate in a Long Term Evolution Advanced (LTE-A) ultra-mid-frequency band. The second radiating portion A2*a* can operate in an LTE-A high-frequency band.

Figure 14:
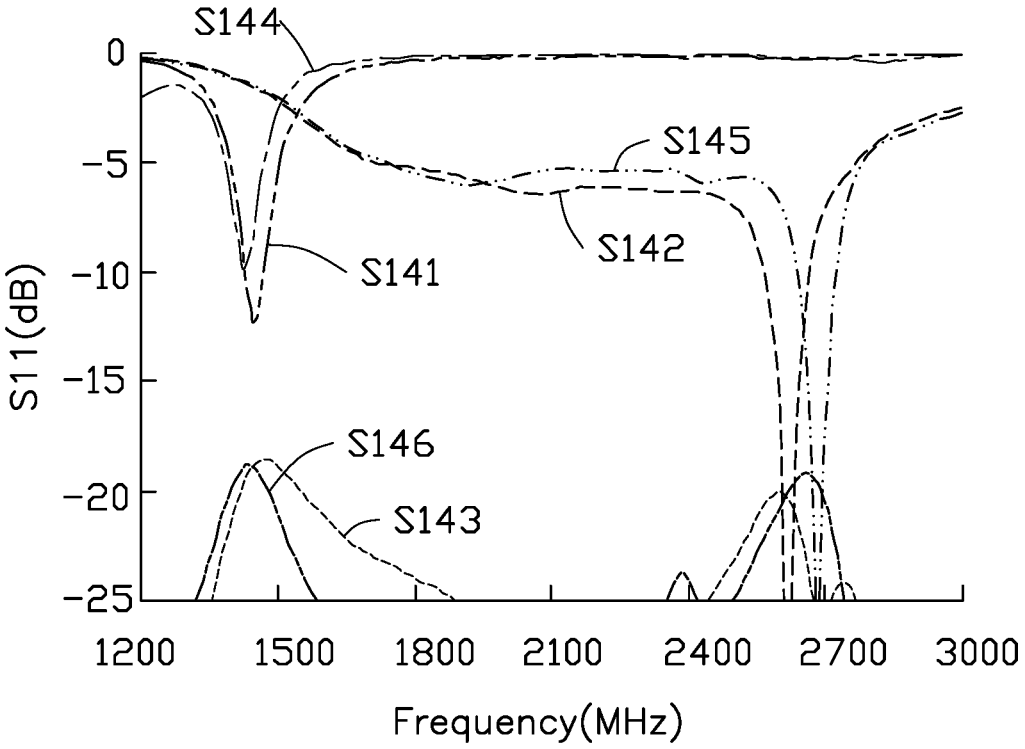
FIG. 14 is a graph of S11 values of the antenna structure shown in FIG. 11.

FIG. 14 is a graph of scattering parameters (S11 values) of the antenna structure 100*a*. A plotline S141 is S11 values of the first radiating portion A1*a* operating in the LTE-A ultra-mid-frequency band when the electronic component 23 is in the off state. A plotline S142 is S11 values of the second radiating portion A2*a* operating in the LTE-A mid-high-frequency band when the electronic component 23 is in the off state. A plotline S143 is an isolation degree between the first radiating portion A1*a* and the second radiating portion A2*a* when the electronic component 23 is in the closed state. A plotline S144 is S11 values of the first radiating portion A1*a* operating in the LTE-A ultra-mid-frequency band when the electronic component 23 is in the open state. A plotline S145 is S11 values of the second radiating portion A2*a* operating in the LTE-A mid-high-frequency band when the electronic component 23 is in the open state. A plotline S146 is an isolation degree between the first radiating portion A1*a* and the second radiating portion A2*a* when the electronic component 23 is in the open state.

Figure 15:
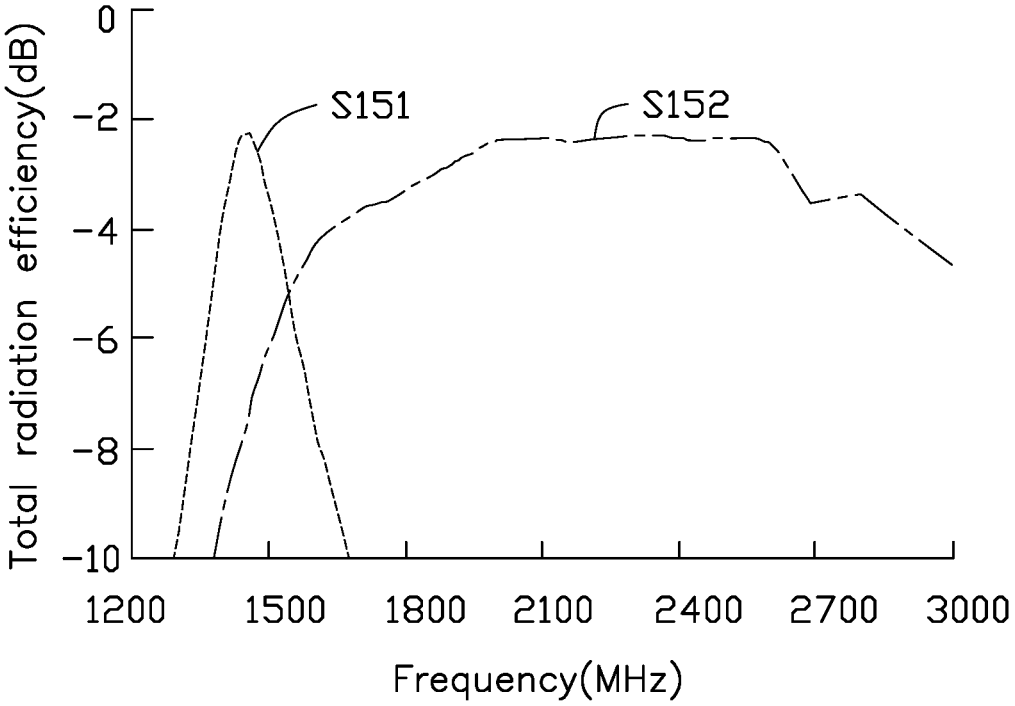
FIG. 15 is a graph of total radiation efficiency of the antenna structure when the electronic component of FIG. 11 is in the closed state.

FIG. 15 is a graph of total radiation efficiency of the antenna structure 100*a* when the electronic component 23 is in the off state. A plotline S151 is the total radiation efficiency of the first radiating portion A1*a* operating in the LTE-A ultra-mid-frequency band when the electronic component 23 is in the off state. A plotline S152 is the total radiation efficiency of the second radiating portion A2*a* operating in the LTE-A mid-high-frequency band when the electronic component 23 is in the off state.

Figure 16:
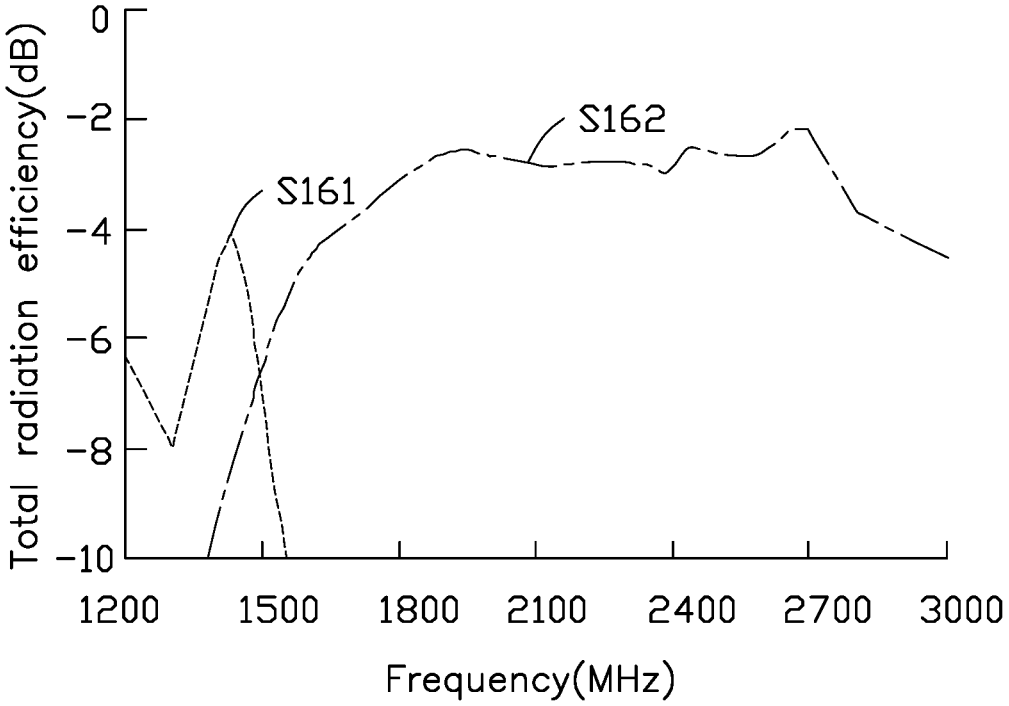
FIG. 16 is a graph of total radiation efficiency of the antenna structure when the electronic component of FIG. 11 is in the open state.

FIG. 16 is a graph of total radiation efficiency of the antenna structure 100*a* when the electronic component 23 is in the open state. A plotline S161 is the total radiation efficiency of the first radiating portion A1*a* operating in the LTE-A ultra-mid-frequency band when the electronic component 23 is in the open state. A plotline S162 is the total radiation efficiency of the second radiating portion A2*a* operating in the LTE-A mid-high-frequency band when the electronic component 23 is in the open state.

As shown in FIGS. 14-16, when the electronic component 23 is in the open state or the closed state, the first antenna (the first radiating portion A1*a*) and the second antenna (the second radiating portion A2*a*) have a wide bandwidth and good isolation therebetween. The isolation value between the two is less than −15 dB. Furthermore, when the electronic component 23 is in the open state or the closed state, the total radiation efficiency of the first antenna (the first radiating portion A1*a*) and the total radiation efficiency of the second antenna (the second radiating portion A2*a*) both are greater than −5 dB, thereby meeting antenna design requirements.

In other embodiments, by changing positions of the first gap 120, the second gap 121, the first feed portion 12, and the second feed portion 13, the operating frequency of the first radiating portion A1/A1*a* and the second radiating portion A2/A2*a* can also be changed.

In other embodiments, the first antenna and the second antenna may be a GPS antenna, a WIFI antenna, an LTE-A main antenna, an LTE-A sub antenna (diversity antenna), a BLUETOOTH antenna, or a Near Field Communication (NFC) antenna.

In other embodiments, the two ground portions are not limited to be coupled to the first radiating portion A1/Ala, and may be electrically coupled to the second radiating portion A2/A2*a*, as long as the two ground portions are located between the first feed portion 12 and the second feed portion 13.

In other embodiments, the electronic component 23 may be omitted.

In the antenna structure 100/100*a* and the wireless communication device 200/200*a* having the antenna structure 100/100*a*, the first gap 120 and the second gap 121 are located on the same side of the border frame 110. Moreover, the at least two ground portions can effectively improve the isolation between the first radiating portion A1 and the second radiating portion A2 and achieve a wide frequency range and good antenna efficiency. Furthermore, the antenna structure 100/100*a* can be applied in an environment where the antenna space is limited, and the electronic component 23 can effectively avoid the antenna structure while ensuring screen integrity of the display unit 201.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An antenna structure comprising:

a border frame;

a first feed portion;

a second feed portion;

at least two ground portions; wherein:

the border frame is made of metal;

the border frame comprises an end portion, a first side portion, and a second side portion;

the first side portion and the second side portion facing each other are respectively coupled to two ends of the end portion perpendicularly;

a length of the first side portion and the second side portion is longer than a length of the end portion;

the border frame further comprises a first gap and a second gap passing through the border frame, thereby defining a first radiating portion and a second radiating portion;

the first radiating portion is partially disposed in the first side portion;

the second radiating portion is entirely disposed in the first side portion;

the first feed portion is electrically coupled to the first radiating portion to supply an electric current to the first radiating portion;

the second feed portion is electrically coupled to the second radiating portion to supply an electric current to the second radiating portion;

the at least two ground portions are disposed between the first feed portion and the second feed portion and separated from each other;

the at least two ground portions are electrically coupled to the first radiating portion or the second radiating portion to improve isolation between the first radiating portion and the second radiating portion;

wherein the first radiating portion is disposed in the end portion and the first side portion.

2. The antenna structure of claim 1, wherein:

the first gap is formed in the first side portion or the end portion;

the second gap is spaced from the first gap;

the second gap is formed in the first side portion on a side of the first gap away from the end portion;

the first radiating portion is defined as a portion of the border frame between the first gap and the second gap;

the second radiating portion is defined as a portion of the first side portion on a side of the second gap away from the first gap.

3. The antenna structure of claim 2, wherein the at least two ground portions comprise:

one end of the first feed portion is electrically coupled to the first radiating portion, and a second end of the first feed portion is electrically coupled to a first feed source through a first matching circuit to supply an electric current to the first radiating portion;

one end of the second feed portion is electrically coupled to the second radiating portion, and a second end is electrically coupled to the second feed source through a second matching circuit to supply an electric current to the second radiating portion;

one end of a first ground portion is electrically coupled to the first radiating portion or the second radiating portion, and a second end of the first ground portion is grounded through a first load circuit;

one end of a second ground portion is electrically coupled to the first radiating portion or the second radiating portion, and a second end of the second ground portion is grounded through a second load circuit.

4. The antenna structure of claim 1, wherein:

the first radiating portion or the second radiating portion is a Global Positioning System (GPS) antenna, a WIFI antenna, a Long Term Evolution Advanced (LTE-A) main antenna, an LTE-A sub antenna, a BLUETOOTH antenna, or a Near Field Communication (NFC) antenna.

5. A wireless communication device comprising an antenna structure comprising:

a border frame;

a first feed portion;

a second feed portion;

at least two ground portions; wherein:

the border frame is made of metal;

the border frame comprises an end portion, a first side portion, and a second side portion;

the first side portion and the second side portion facing each other are respectively coupled to two ends of the end portion perpendicularly;

a length of the first side portion and the second side portion is longer than a length of the end portion;

the border frame further comprises a first gap and a second gap passing through the border frame, thereby defining a first radiating portion and a second radiating portion;

the first radiating portion is partially disposed in the first side portion;

the second radiating portion is entirely disposed in the first side portion;

the first feed portion is electrically coupled to the first radiating portion to supply an electric current to the first radiating portion;

the second feed portion is electrically coupled to the second radiating portion to supply an electric current to the second radiating portion;

the at least two ground portions are disposed between the first feed portion and the second feed portion and separated from each other;

the at least two ground portions are electrically coupled to the first radiating portion or the second radiating portion to improve isolation between the first radiating portion and the second radiating portion;

wherein the first radiating portion is disposed in the end portion and the first side portion.

6. The wireless communication device of claim 5, wherein:

the first gap is formed in the first side portion or the end portion;

the second gap is spaced from the first gap;

the second gap is formed in the first side portion on a side of the first gap away from the end portion;

the first radiating portion is defined as a portion of the border frame between the first gap and the second gap;

the second radiating portion is defined as a portion of the first side portion on a side of the second gap away from the first gap.

7. The wireless communication device of claim 6, wherein:

the at least two ground portions comprise two ground portions;

one end of the first feed portion is electrically coupled to the first radiating portion, and a second end of the first feed portion is electrically coupled to a first feed source through a first matching circuit to supply an electric current to the first radiating portion;

one end of the second feed portion is electrically coupled to the second radiating portion, and a second end is electrically coupled to the second feed source through a second matching circuit to supply an electric current to the second radiating portion;

one end of a first ground portion is electrically coupled to the first radiating portion or the second radiating portion, and a second end of the first ground portion is grounded through a first load circuit;

one end of a second ground portion is electrically coupled to the first radiating portion or the second radiating portion, and a second end of the second ground portion is grounded through a second load circuit.

8. The wireless communication device of claim 7, wherein:

the first radiating portion or the second radiating portion is a Global Positioning System (GPS) antenna, a WIFI antenna, a Long Term Evolution Advanced (LTE-A) main antenna, an LTE-A sub antenna, a BLUETOOTH antenna, or a Near Field Communication (NFC) antenna.

9. The wireless communication device of claim 8 further comprising a display unit arranged on a side of the border frame, wherein the display unit comprises a complete unnotched display plane.

10. The wireless communication device of claim 8 further comprising a backplane, wherein:

the backplane is made of metal;

the backplane is arranged on a periphery of the border frame and is integrally formed with the border frame.

11. The wireless communication device of claim 8 further comprising an electronic component, wherein:

the electronic component slides relative to the border frame;

the first gap, the second gap, the first radiating portion, and the second radiating portion are on a same side of the electronic component.

12. The wireless communication device of claim 11, wherein the electronic component is an optical module or an acoustic module.

* * * * *